US005124515A

United States Patent [19]

Mous

[11] Patent Number: 5,124,515

[45] Date of Patent: Jun. 23, 1992

[54] SWITCHING MECHANISM

[75] Inventor: Frans Mous, Drachten, Netherlands

[73] Assignee: U.S. Philips Corp., New York, N.Y.

[21] Appl. No.: 427,439

[22] Filed: Oct. 24, 1989

[30] Foreign Application Priority Data

Nov. 29, 1988 [NL] Netherlands ..... 8802937

[51] Int. Cl.[5] ..... H01H 13/14; H01H 9/26

[52] U.S. Cl. ..... 200/552; 200/518; 200/537; 200/329; 200/341; 200/5 E; 200/5 B; 200/5 EA

[58] Field of Search ..... 200/330, 518, 534, 537, 200/329, 341, 345, 5 B, 5 E, 520, 521, 516, 517, 50 C, 5 EA, 552; 74/483 PB, 110, 520

[56] References Cited

U.S. PATENT DOCUMENTS

| | | | |
|---|---|---|---|
| 2,519,899 | 8/1950 | Gaynor | 200/552 |
| 2,523,786 | 9/1950 | Soreng | 200/552 |
| 2,639,338 | 5/1953 | Kwasniewski | 200/552 |
| 3,303,295 | 2/1967 | Davis | 200/552 |
| 3,668,356 | 6/1972 | Kekas | 200/345 |
| 4,086,451 | 4/1978 | Boulanger | 299/329 |
| 4,096,935 | 6/1978 | Hanakata et al. | 200/5 B |
| 4,343,973 | 8/1982 | Main | 200/534 |
| 4,471,189 | 9/1984 | Bacon et al. | 200/521 |
| 4,539,860 | 9/1985 | Johnston et al. | 200/5 EA |

FOREIGN PATENT DOCUMENTS

| | | |
|---|---|---|
| 2359971 | 6/1975 | Fed. Rep. of Germany . |
| 3130244 | 2/1983 | Fed. Rep. of Germany . |

*Primary Examiner*—Ernest G. Cusick
*Assistant Examiner*—Keith Kupferschmid
*Attorney, Agent, or Firm*—Ernestine C. Bartlett

[57] ABSTRACT

A switching mechanism is provided including a control member and a switching element which is coupled to the control member and by means of a coupling element can be moved between a first and a second position. The switching mechanism includes two coupling elements which are arranged in series in the switching direction, each coupling element being constituted by a hinging V-shaped member, a point of intersection of a V-shaped member being alternately located within range for action thereon by the control member.

5 Claims, 1 Drawing Sheet

SWITCHING MECHANISM

FIELD OF THE INVENTION

The invention relates to a switching mechanism including a control member and a switching element which is coupled to the control member and by, means of a coupling element, can be moved between a first and a second position.

BACKGROUND OF THE INVENTION

Such a switching mechanism is disclosed in the DE-AS 23 59 971. In this prior art construction the control member is constituted by a pushbutton which is coupled to the resilient coupling element in both directions of travel. This means that when, for example, an apparatus is switched on by depressing the pushbutton this switched-on state is only maintained as long as the button is depressed. In certain circumstances it may however be desirable for the switched-on state to be maintained when the pusbhutton is released and that, to switch the apparatus off, the switching mechanism must be operated again.

SUMMARY OF THE INVENTION

For that purpose the invention has for its object the provision of a structurally simple and cheap solution and is characterized, in that the switching mechanism includes two series-arranged coupling elements, each coupling element being constituted by a pivotal V-shaped member and a point of intersection of a V-shaped member being alternately located within range of the control member.

In preferred embodiments of the invention, any or all of the following features may be present wherein: (a) the switching element is provided between the two V-shaped coupling elements; (b) the switching elements and the two coupling elements are designed as an integrated component made of a synthetic resin material; (c) each coupling element includes a push button which can be depressed in a direction transversely of the switching direction; and/or the control member is constituted by a knob which is slidable in the switching direction and has two sloping walls, the points of intersection of the V-shaped members being alternately located within range of a sloping wall.

BRIEF DESCRIPTION OF THE DRAWINGS

The invention will now be described by way of example with reference to two embodiments shown in the accompanying Figures.

DETAILED DESCRIPTION OF PREFERRED EMBODIMENTS

According to the invention, the switching mechanism includes a control member and a switching element which is coupled to the control member and can be moved between a first and second position. The switching mechanism includes two series arranged coupling elements each of which can be moved from a first position to a second position and each such movement effects movement of the switching element from a first position to a second position. Movement of each coupling element is effected by action of the control member and each coupling element is constituted by a hinging V-shaped member, a point of intersection of a V-shaped member being alternately located with the range of action of the control member.

Figure 1:
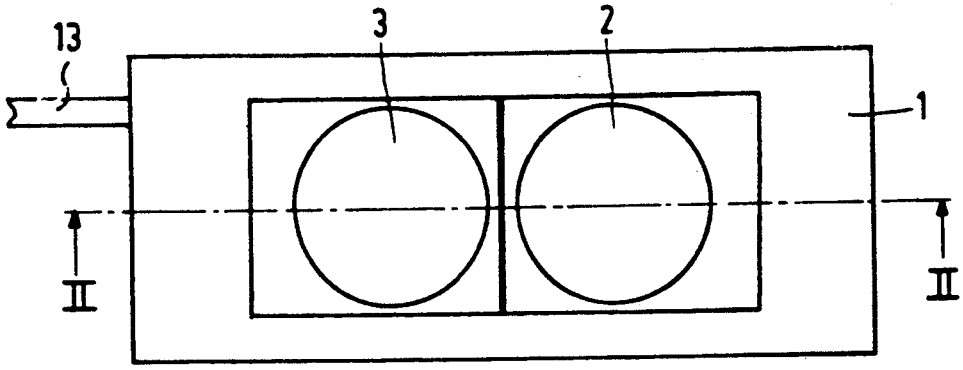
FIG. 1 is a plan view of a switching mechanism according to the invention.
Figure 2:
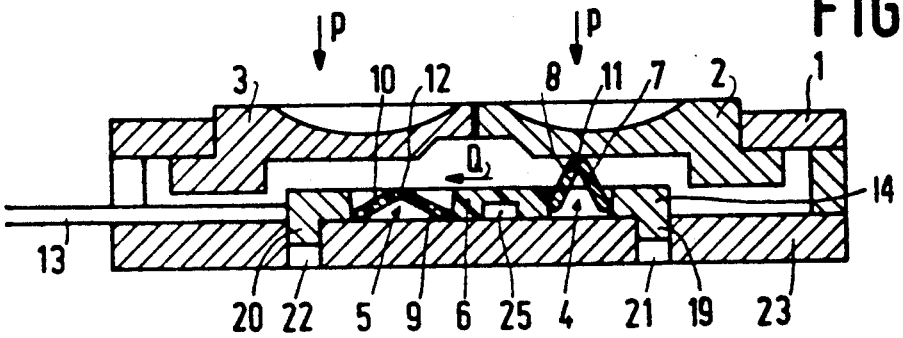
FIG. 2 is a cross-sectional view taken on the line II—II in FIG. 1.

The switching mechanism shown in FIGS. 1 and 2 includes a housing 1 having two control members constituted by pushbuttons 2 and 3. These pushbuttons 2 and 3 are movable separately and independently and can be supported in known manner by spring means, not shown. The respective coupling elements 4 and 5 are located under the pushbuttons 2 and 3, the switching element 6 being located between the coupling elements. The coupling elements 4 and 5 have V-shaped cross-sections i.e., legs 7, 8 and 9, 10 respectively, these legs being pivotally or hingedly interconnected in the respective points of intersection, i.e., at the point of the V where the legs intersect, 11 and 12.

In the situation shown in FIG. 2, the legs 7 and 8 of coupling element 4 enclose an acute angle whereas the legs 9 and 10 of coupling element 5 enclose an obtuse angle. As a result thereof, the point of intersection 11 of the coupling element 4 bears against the bottom side of pushbutton 2. If the pushbutton 2 is depressed in the direction indicated by the arrow P, coupling element 4 will be pushed into a position as shown in FIG. 2 for coupling element 5, the legs 7 and 8 of the element 4 then enclosing an obtuse angle. The switching element 6 is then moved in the direction of the arrow Q transversely of the direction of the arrow P by pressure exerted on the switching element by the legs 7 and 8 as they are moved from the acute to obtuse angle positions by pressure exerted on the push button 2. This motion of the switching element renders in possible to operate, for example, an electric switch with the aid of the switching arm 13, (see also FIG. 3). The coupling element 4 does not tend to return to the original configuration so that, when pushbutton 2 is released, the position of the switching element 6 does not change. Coupling element 5 has however now arrived in a position as shown in FIG. 2 for coupling element 4, the legs 9 and 10 meeting at an acute angle. The point of intersection 12 of coupling element 5 now bears against the bottom side of pushbutton 3 or is within range of this pushbutton. If now the pushbutton 3 is depresssed in the direction P, switching element 6 with switching arm 13 can again be moved in the direction opposite to Q, causing the original situation as illustrated in FIG. 2 to be regained.

Figure 3:
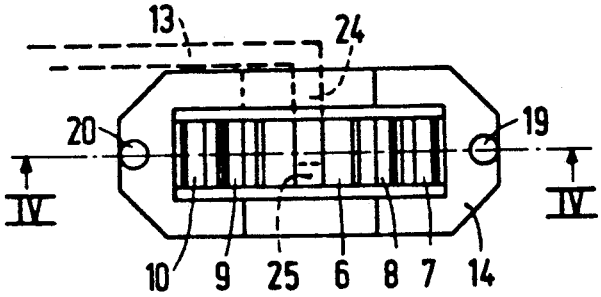
FIG. 3 is a bottom view of the integrated molding of switching elements and coupling elements.
Figure 4:
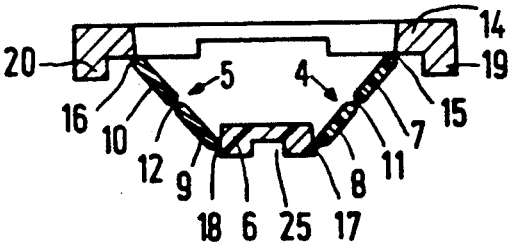
FIG. 4 is a cross-sectional view taken on the line IV—IV in FIG. 3.

As is shown in FIGS. 3 and 4, the coupling elements 4 and 5 and the switching element 6 are produced, together with a frame 14, as an integrated component which is easy and cheap to manufacture. By forming what are commonly denoted integral hinges 15 and 16, the respective legs 7 and 10 are connected to the frame 14. The legs 8 and 9 are connected to the switching element via the respective integral hinges 17 and 18. FIGS. 3 and 4 show the integrated component after production by injection molding. The integrated component is provided with projections 19 and 20 by means of which it can be fitted in the corresponding apertures 21 and 22 of the wall 23 of the housing 1 (FIG. 2). The switching arm 13 is indicated in FIG. 3 by broken lines and has a hooked end 24 located in a recess 25 of the switching element 6.

Thus, a very flat and compact structure of the switching mechanism is obtained, rendering it particularly suitable for hand-held apparatus such as an electric shaver in which very little space is available between the wall of the housing and the components contained therein.

Figure 5:
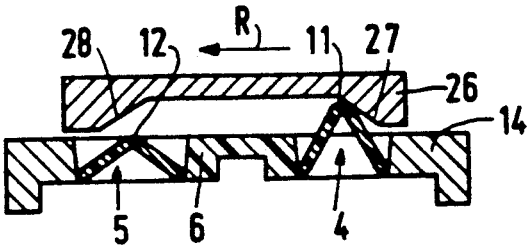
FIG. 5 is a schematical cross-sectional view in accordance with FIG. 2 of a variant of the embodiment shown in FIGS. 1 to 4.

FIG. 5 relates to a variant of the embodiment shown in FIGS. 1 to 4 with coupling elements 4 and 5, side element 6 and frame 14. The control member is constituted by a knob 26 which is slidable in the direction of the arrow R. The point of intersection 11 bears against the sloping wall 27 of knob 26 or is located within reach thereof. If the knob 26 is moved in the direction R, the coupling element 4 will be pushed in a position corresponding to the position shown for coupling element 5, because of the sloping wall 27. This causes, in a similar manner as in the embodiment shown in FIGS. 1 to 4, the switching element 6 to be moved in the direction R. The point of intersection 12 has then come within range of the sloping wall 28, so that, when the knob 26 is moved in a direction opposite to R, the switching element is also moved again in that direction.

In the embodiment described in the foregoing the switching element 6 can be moved through a distance which is considerably greater than the distance through which the control member (2, 3 or 26) is moved, because of the use of the V-shaped coupling elements.

I claim:

1. A switch mechanism which comprises a housing having a control member mounted in said housing for movement in a first path and a slide element mounted therein such that said slide element is actuated by movement of the control member to slide in a second path between a first switching position and a second switching position said switching mechanism including two series-arranged coupling elements movably mounted in said housing, each coupling element being constituted by a V-shaped member the segments of which are hingedly connected at its apex which moves transverse to the direction of movement of said slide element each V-shaped member being mounted in said housing such that each apex is alternating located within the first path of movement of the control member, said slide element being located between the two V-shaped coupling elements.

2. A switching mechanism as claimed in claim 1 or 2, wherein the slide element and the two coupling elements are designed as an integrated component made of synthetic resin material.

3. A switching mechanism as claimed in claim 1, wherein the control member includes pushbuttons which can be depressed in a direction transversely of the direction of movement of the switching element.

4. A switching mechanism which comprises a housing having two control members each mounted for pressed movement in a first path and a slide element slidingly mounted in said housing in a second path and coupled to the control members by V-shaped coupling elements, a point of intersection of the legs of each V-shaped coupling element being hinged and located adjacent a respective one of said control members, each V-shaped coupling element being in a different position with respect to each other and being movable upon depression of a respective one of said control members between a first position in which it has the shape of an acute angle and a second position in which it has the shape of an obtuse angle, each said movement of one of said V-shaped coupling elements causing movement of the slide element between a first and second switching position between said coupling elements, the position of each coupling element and of the slide element being unaffected by release of each control member, said slide member being located between the two V-shaped coupling elements.

5. A switching mechanism as claimed in claim 4 wherein the control members are push-buttons which upon depression move the V-shaped coupling element from an acute angle to an obtuse angle position.

* * * * *